US006137407A

United States Patent [19]

Akagawa et al.

[11] Patent Number: 6,137,407

[45] Date of Patent: Oct. 24, 2000

[54] HUMANOID DETECTOR AND METHOD THAT SENSES INFRARED RADIATION AND SUBJECT SIZE

[75] Inventors: Keiichi Akagawa, Kamakura; Hitoshi Nomura, Kawasaki, both of Japan

[73] Assignee: Nikon Corporation of Tokyo, Japan

[21] Appl. No.: 09/441,389

[22] Filed: Nov. 16, 1999

[30] Foreign Application Priority Data

Nov. 20, 1998 [JP] Japan ..... 10-330903

[51] Int. Cl.[7] ..... G08B 13/18

[52] U.S. Cl. ..... 340/552; 340/541; 340/573; 340/565

[58] Field of Search ..... 340/552, 541, 340/565, 500, 825.31, 583, 573, 573.1, 573.4, 567, 522, 555, 556, 557

[56] References Cited

U.S. PATENT DOCUMENTS

| | | | |
|---|---|---|---|
| 5,153,560 | 10/1992 | Ichikawa | 340/522 |
| 5,155,474 | 10/1992 | Park et al. . | |
| 5,180,333 | 1/1993 | Shyu | 454/319 |
| 5,448,320 | 9/1995 | Sakai et al. . | |
| 5,473,368 | 12/1995 | Hart | 348/155 |
| 5,686,942 | 11/1997 | Ball | 345/158 |

FOREIGN PATENT DOCUMENTS

| | | |
|---|---|---|
| 09161419 | 11/1998 | Japan . |
| 09158342 | 1/1999 | Japan . |

OTHER PUBLICATIONS

U.S. patent application No. 09/178,054.

*Primary Examiner*—Jeffery A. Hofsass
*Assistant Examiner*—Daniel Prévil
*Attorney, Agent, or Firm*—Ipsolon LLP

[57] ABSTRACT

A humanoid detector for detecting a humanoid in a surveillance area that substantially reduces false intruder indications by having two types of sensors that provide two types of information of the surveillance area, is disclosed. A first sensor detects light images and determines a size of a moving object within the surveillance area and compares the size of detected moving objects to a threshold size to reduce intruder detection caused by small animals. A second sensor detects infrared radiation from the surveillance area provides a detected infrared radiation signal. A decision circuit receives the sensor signals and provides a decision signal that indicates a human intruder in the surveillance area when, simultaneously, the size of the moving body is greater than that of a small animal and the detected infrared radiation indicates that the moving body is a heat producing body. In order to compensate for differences in the sensors and to account for different physical properties in the surveillance area, the decision circuit holds high an intruder signal for a predetermined time from each sensor. Thus, if a signal occurs that indicates a moving body is larger than a small animal, that signal is held for a predetermined time interval and if a signal indicates a sufficient increase in the infrared radiation occurs while the moving body signal is being held, then the decision circuit determines that a human intruder has entered the surveillance area. The decision signal may be used to trigger an audible or visible indication.

29 Claims, 3 Drawing Sheets

HUMANOID DETECTOR AND METHOD THAT SENSES INFRARED RADIATION AND SUBJECT SIZE

BACKGROUND OF THE INVENTION

1. Field of the Invention

The present invention pertains to a humanoid detector and a method of detecting a humanoid within a surveillance area using the humanoid detector.

2. Description of the Related Art

Human body detection apparatuses detect humanoid intruders in a surveillance area. The surveillance area is an area of interest that is being surveyed to detect intruders. Human body detection apparatuses may also be useful in combination with air conditioning, or lighting, control apparatuses that automatically control air conditioning, or lighting, according to whether or not a human being is present in an area.

A first type of human body detection apparatus is a pyroelectric infrared sensor that detects a human body by detecting a temperature change in a field of view. This type of sensor relies upon a fact that a human body temperature is higher than an ambient temperature. Thus, when a high-temperature object (i.e., the object's internal temperature is greater than ambient temperature) enters a field of view of a pyroelectric infrared sensor, the object radiates infrared rays that are incident on the pyroelectric infrared sensor causing the sensor to generate a voltage. A human body detection apparatus containing such a pyroelectric infrared sensor is preset with a threshold voltage for deciding whether or not an object which enters the field of view is a human body. That is, when the voltage generated by the pyroelectric infrared sensor exceeds the threshold voltage, the object is presumed to be a human body.

The pyroelectric infrared sensor in a conventional human body detection apparatus is an infrared point sensor, and it cannot generate an infrared image. Therefore, a conventional human body detection apparatus that exclusively uses a pyroelectric infrared sensor cannot determine a size of an object that is radiating the infrared rays. Further, a human detection apparatus that exclusively uses a pyroelectric infrared sensor often cannot distinguish between incident infrared rays radiated by a human body versus those radiated by a small animal. Accordingly, such sensors have the problem of erroneously detecting small animals as human intruders.

A second type of prior art human body detection apparatus uses a pyroelectric infrared image sensor. Such infrared image sensors can reduce the aforesaid erroneous detection of small animals as humanoid intruders by detecting the size of the subject based on the infrared image. However, a pyroelectric infrared image sensor is expensive as compared to an infrared point sensor. Also, a lens for an infrared image sensor is very expensive as compared to a lens for a visible light image sensor. Accordingly, the cost of a human body detector that contains a pyroelectric infrared image sensor is more expensive than other types of human body detectors.

Also, miniaturizing a human body detection apparatus that contains a pyroelectric infrared image sensor is more difficult than with other detectors, such as those using infrared point sensors or visible light image sensors.

A third type of human body detection apparatus contains a visible light image sensor that detects a moving body by comparing a continuously generated image. Upon detection of the moving body, this type of detection apparatus determines a size of the detected body and, if the body complies with predetermined parameters, decides that the body is humanoid. However, this type of human body detection apparatus can produce erroneous results when any large-body motion is detected, such as a curtain that is swayed by the wind.

There are monitoring devices that have a pyroelectric infrared sensor for sensing infrared radiation to detect intruders and a visible light image sensor for recording image data of the surveillance area when a temperature difference is detected by the infrared sensor. But these monitoring devices merely record the image generated by the imaging element and do not use image information to electronically decide whether the body that caused the infrared radiation is humanoid. Thus, image recording occurs even if a small animal intrudes into the surveillance area, so long as the animal is large enough to trigger the infrared sensor's threshold setting.

SUMMARY OF THE INVENTION

The present invention solves the above-noted deficiencies of the prior art by providing a high-performance human body detector that is relatively inexpensive and more accurate than prior art detection apparatuses that rely on pyroelectric infrared image sensors and that is relatively more accurate and reliable than prior art detection apparatuses that rely on pyroelectric infrared point sensors or visible light image sensors.

The human body detector of the present invention includes a moving body detection sensor that detects a moving body using a visible light image in combination with an infrared sensor. In preferred embodiments, the visible light sensor provides a signal to a human body detection circuit. The human body detection circuit then analyzes the size of the detected moving body and decides whether the moving body is of a size substantially equivalent to a human body size. The human body detection circuit also analyzes the infrared radiation detected by the infrared sensor to determine if the detected infrared radiation is substantially equivalent to infrared radiation of a human body. If the detection circuit determines that the size of the moving body is substantially human-size and the detected infrared radiation is above a threshold value, then the detection circuit decides that the intruder is human.

Accordingly, the human body detector of the present invention reliably reduces erroneous detection as compared to a human body detection apparatus of the prior art that includes only a moving body detection sensor or only an infrared sensor.

Also, the infrared sensor of the present invention need not generate an infrared image. Thus, the present invention may incorporate an infrared image sensor having very few pixels that does not generate an infrared image (for example, an infrared image sensor consisting of only four pixels in a 2×2 matrix). Such infrared image sensors are relatively inexpensive as compared to infrared image sensors that have a large plurality of pixels, which are required to generate an infrared image.

Thus, the human body detector of the present invention can achieve low cost and small size as compared to a human body detection apparatus provided with an infrared image sensor that generates an infrared image.

Preferably, the moving body detection sensor of the present invention is a visible light image sensor that detects a moving body by repeatedly imaging a field of view (i.e., a surveillance area). The moving body sensor generates a stream of sequential electrical signals corresponding to incident light on the sensor and compares those successive electrical signals and generates a difference signal that indicates whether or not a change occurred within the field of view.

Also, in preferred embodiments, the human body detector of the present invention is arranged so that the infrared sensor and visible light image sensor share at least part of the same field of view.

In preferred embodiments, the human body detection apparatus of the present invention is further characterized in that the human body detection circuit decides that the moving body is a human body if a level of infrared radiation, or a change in the level of infrared radiation, that is detected by the infrared sensor reaches or exceeds a predetermined value during a predetermined time interval after the size of the moving body reaches or exceeds a predetermined size. Alternatively, the human body detection circuit may decide that the subject is humanoid if the size of the subject exceeds a predetermined size during a particular time interval after the infrared level, or change in the infrared level, detected by the infrared sensor reaches or exceeds a predetermined value.

Generally the time until a moving body detection sensor detects a moving body is different from the time until an infrared sensor detects the predetermined infrared level, or the change in the infrared level. Also, there may be instances in which the level of infrared radiation, or the change in the level of infrared radiation, reaches or exceeds the predetermined value because a part of a human being with a high temperature, such as an uncovered face or hands, enters the infrared sensor's field of view, but the size of the moving body does not reach or exceed the predetermined size because only a small portion of the human body has entered the field of view.

Therefore, the first moment of confirmation that the size of a moving body has reached or exceeded the predetermined size and the first moment of confirmation that the infrared level, or the change in the infrared level, has reached or exceeded the predetermined value do not always coincide, and a time lag between detection signals can occur. The human body detector of the present invention can eliminate errors due to this sort of time lag by holding the respective signals at a high level (indicating that the size has reached the predetermined size, or the infrared radiation level has reached the predetermined value) for a preselected time interval.

Preferably, the human body detector of the present invention uses a pyroelectric infrared sensor. Human body detectors are often installed in difficult access locations, such as high places, where replacement is not easy. Therefore, a pyroelectric infrared sensor, which has better durability than a cooled-type infrared sensor whose life is limited by the cooling device, is desirable.

A pyroelectric infrared sensor is also preferred because it provides a signal indicating an amount of change only when the level of infrared radiation changes. Thus, such a sensor is more suitable for a human body detection apparatus than an infrared sensor which detects the absolute level of infrared radiation.

The human body detector of the present invention may further include an alarm generation circuit that generates an alarm if the decision circuit decides that the moving body is a human being. Alternatively, the present invention may include other intrusion indicators that are triggered when the decision circuit decides that a moving body in the field of view is a human body.

In preferred embodiments, the human body detection method of the present invention detects a moving body using a visible light image to measure a size of the moving body and an infrared sensor to detect an infrared radiation level, or a change in the infrared radiation level, within a field of view. The method further includes comparing the size of the moving body to a predetermined body size and comparing the amount, or change in the amount, of infrared radiation to a predetermined value to determine that the subject body is humanoid. Such combination of body size and infrared radiation in a surveillance field, provides a unique method of providing a reliable indication of a humanoid presence in the surveillance field.

The human body detection method of the present invention reduces erroneous detection as compared to prior art human body detection methods which only detect the size of a moving body, or the amount of infrared rays or the amount of change in infrared rays.

DETAILED DESCRIPTION OF THE PREFERRED EMBODIMENTS

Next, preferred embodiments of the present invention are described with reference to FIGS. 1–3.

Figure 1:
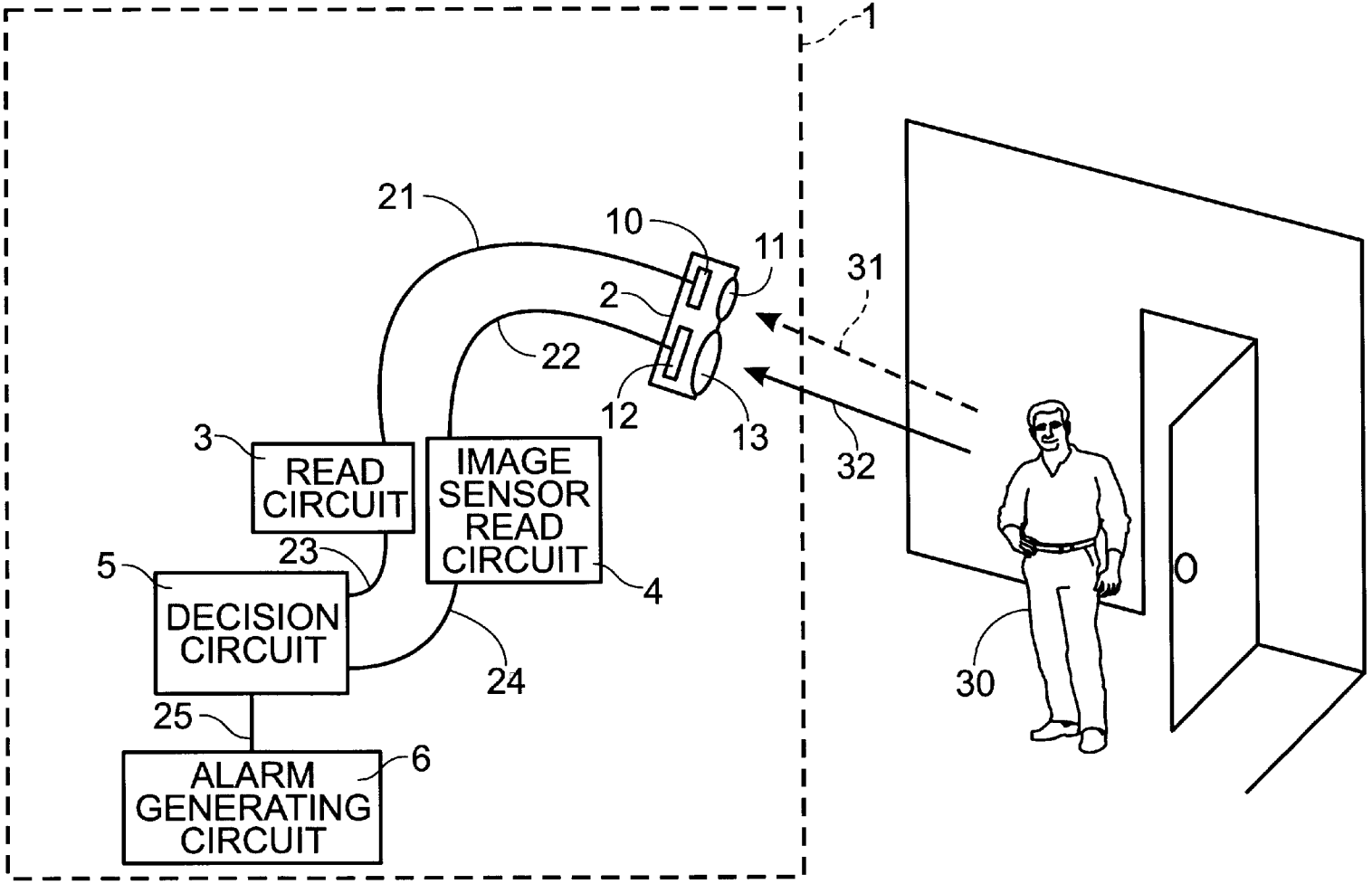
FIG. 1 is a schematic drawing of a preferred embodiment of the present invention showing a humanoid detector receiving incident light and infrared rays from an exemplary surveillance area.

In FIG. 1, an intruder detection apparatus 1 is provided with detection head 2, infrared sensor read circuit 3, image sensor read circuit 4, decision circuit 5, and alarm generation circuit 6. Detection head 2 includes an infrared sensor 10 (preferably, a pyroelectric infrared point sensor), infrared lens 11 30 disposed in front of the infrared sensor 10, visible light image sensor 12 (preferably, a visible light image sensor for moving body detection), and visible light lens 13 disposed in front of the visible light image sensor 12.

Infrared sensor 10 is connected to infrared sensor read circuit 3 via a cable 21. Similarly, visible light image sensor 12 is connected to the image sensor read circuit 4 via a cable 22. Infrared sensor read circuit 3 is connected to decision circuit 5 via a cable 23, and image sensor read circuit 4 is connected to decision circuit 5 via a cable 24. Decision circuit 5 is connected to alarm generation circuit 6 via a cable 25.

Furthermore, detection head 2 is situated at a location where it can receive infrared rays 31 and visible light 32 generated from a subject 30 located within a monitoring, or surveillance, area (not numbered). In FIG. 1, the subject 30 is represented as a humanoid. The positions of the infrared sensor 10 and visible light image sensor 12 are arranged so that their field of view is shared and encompasses the detection area.

Figure 2:
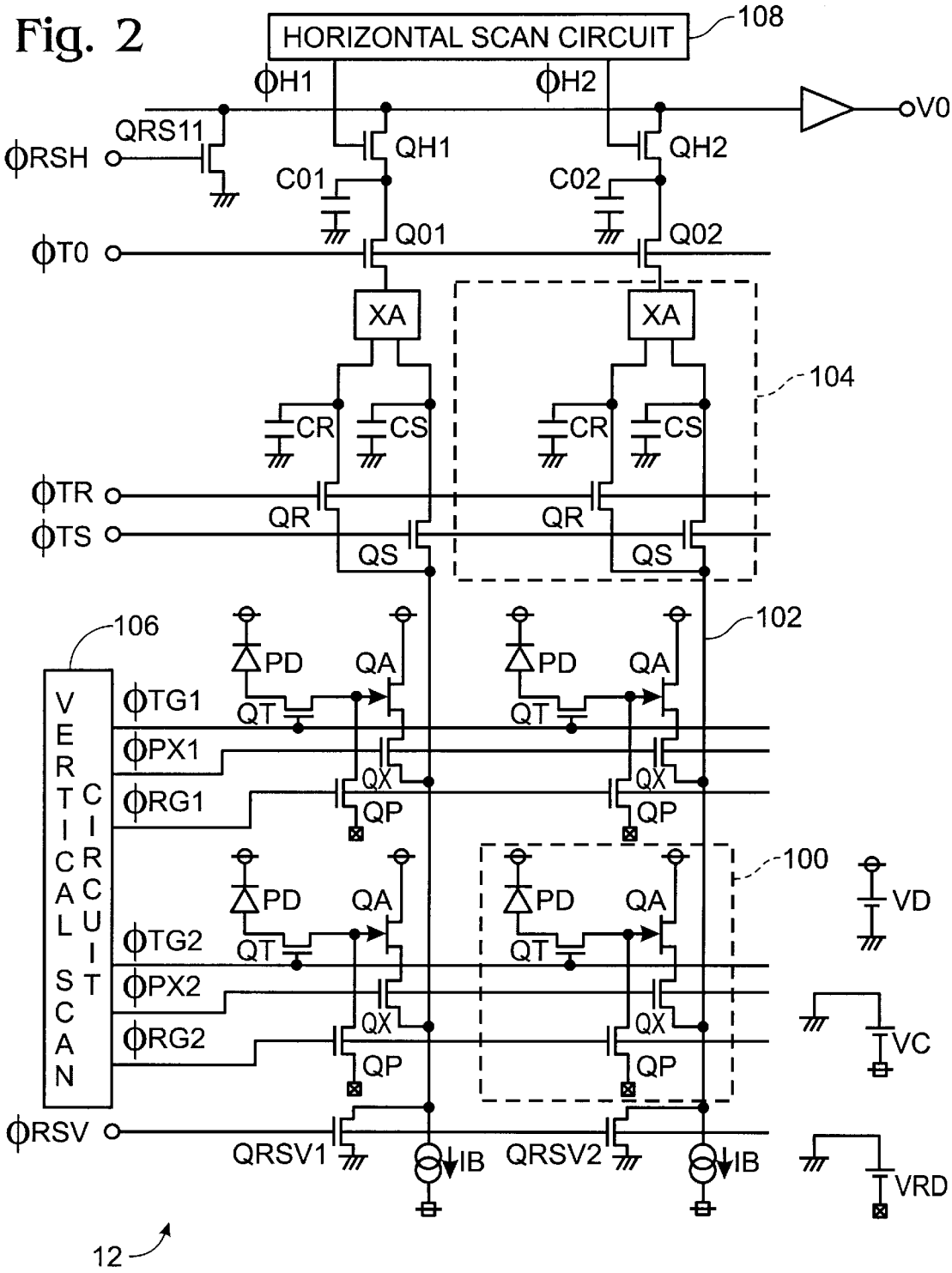
FIG. 2 is a schematic circuit diagram showing a general structure of a visible light image sensor of the present invention.

FIG. 2 is a schematic circuit diagram showing a preferred embodiment of the visible light image sensor 12. In FIG. 2, a plurality of pixels 100 is disposed in a matrix. (For clarity, the plurality of pixels is shown as four pixels arranged in a 2×2 matrix. Preferred embodiments of the visible light image sensor would comprise many more pixels.)

A vertical read line 102 is provided for each column of pixels 100 and is shown aligned in the vertical direction. The vertical read lines 102 are connected to respective transistors QX in pixel 100 and respective difference detection circuits 104.

Each pixel 100 includes a photodiode PD that generates an electric charge corresponding to incident light. A junction-type field effect transistor QA, which outputs an electric signal equivalent to the charge generated by photodiode PD when in communication with the photodiode PD via switching MOS transistor QT. Transistor QT connects or isolates photodiode PD and transistor QA in response to signals ϕTGm (where "m" is a row number corresponding to the position of a pixel being read) from a vertical scan circuit 106. A reset transistor QP discharges charges that accumulate in a gate region of transistor QA. Switching MOS transistor QX connects or isolates vertical read line 102 and transistor QA.

The respective difference detection circuits 104 comprise switching MOS transistors QR and QS, capacitors CR and CS, which store charges corresponding to the electrical signals output at a different times from pixel 100. The difference detection circuits 104 also include a comparison circuit XA, which compares the charges stored in capacitors CR and CS as described in detail below.

Figure 3:
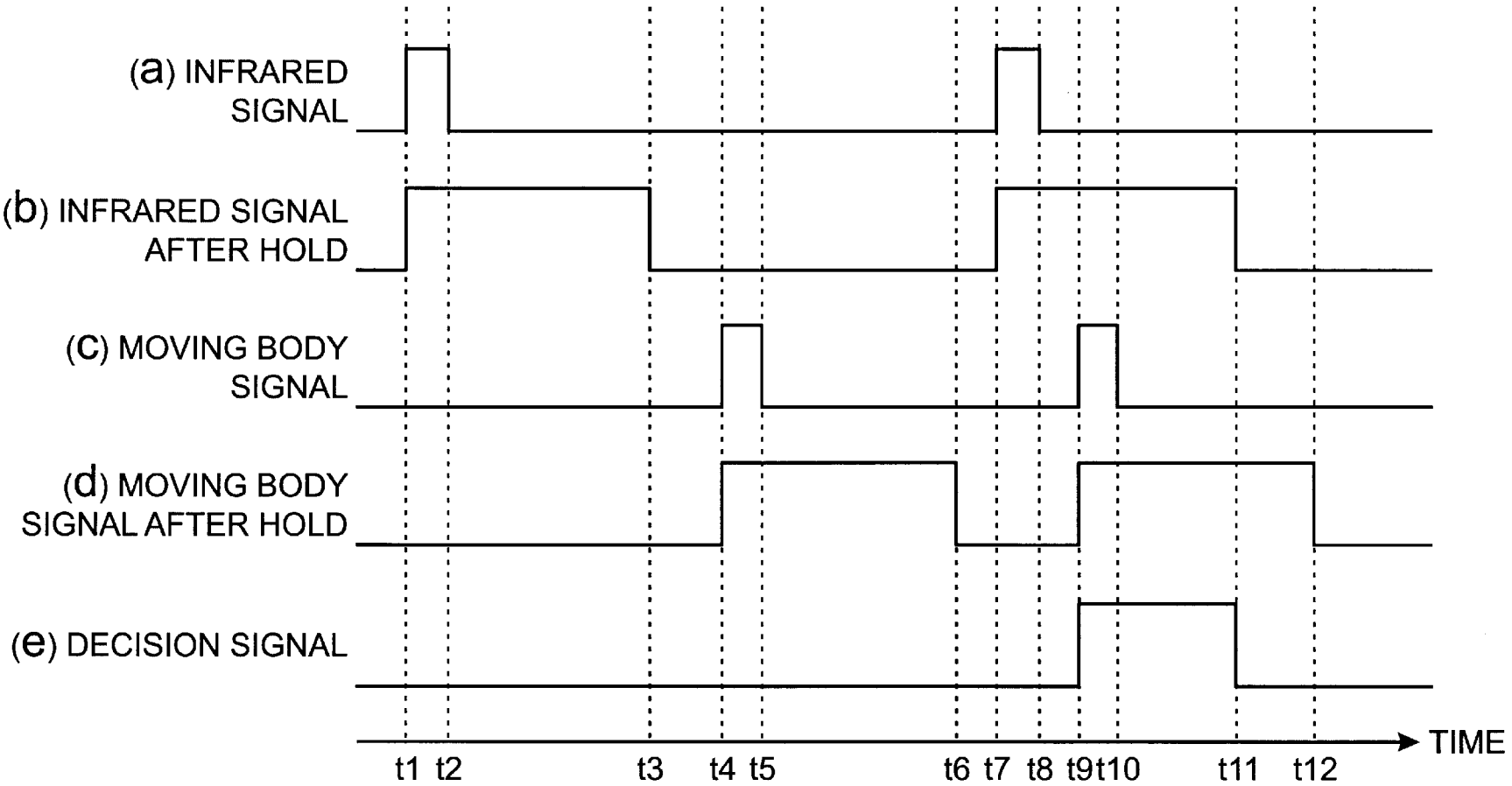
FIG. 3 is a timing diagram showing the signal traces generated in the process of detecting an intruder.

FIG. 3 is a timing diagram showing signals that are generated in the course of detecting an intruder.

Next, the operation of this embodiment is explained with reference to the figures.

Preferably, infrared sensor 10 is a pyroelectric infrared point sensor. The sensor supplies infrared sensor read circuit 3 with an electrical signal corresponding to changes in the level of infrared radiation that passes through infrared lens 11 and are incident on the sensor.

Infrared sensor read circuit 3 decides whether or not the electrical signal supplied from infrared sensor 10 has reached or exceeded a predetermined value, and generates a binary signal indicating its decision result (hereinafter "infrared signal"), and supplies it to the decision circuit 5.

A comparator is suitable as the infrared sensor read circuit 3. The comparator compares a signal from the infrared sensor to a predetermined value stored in the comparator and provides the infrared signal that indicates whether the infrared sensor signal is bigger than the predetermined value.

Furthermore, in FIG. 3, at timing trace (a), the periods t1–t2 and t7–t8 in which the infrared signal is at a high level, indicate a state in which the electrical signal supplied from infrared sensor 10 has reached or exceeded the predetermined value. That is, during these periods the sensor has detected a subject in the surveillance area (e.g., humanoid or small animal) with a temperature (infrared radiation) that is higher than the surroundings.

Meanwhile, visible light image sensor 12 detects a difference between two consecutive frames at the pixel unit, and supplies image sensor read circuit 4 with a binary signal indicating whether or not the difference has reached or exceeded a predetermined value (hereinafter "difference signal"), and correlates it with each pixel.

Here the process of generating a difference signal by visible light image sensor 12 shall be explained. First, at visible light image sensor 12 the optical image obtained from visible light lens 13 is focused on the photoelectric conversion face, where it is photoelectrically converted by photodiode PD in each pixel 100. Timing signals provided by the vertical scan circuit 106 control a transfer of signals from photodiode PD.

The signal charge generated by photodiode PD by this sort of photoelectric conversion is transferred to the gate of transistor QA when transistor QT in pixel 100 is made conductive by timing signal ϕTG2 (in the case of pixel 100 located at row 2). If transistor QT is subsequently made nonconductive, transistor QA's gate region becomes floating, and the aforesaid signal charge from PD is held by a parasitic capacitance effect. That is, transistor QA's gate region stores the signal charge generated by photodiode PD and temporarily holds it.

For lexicographic reasons, a definition of "previous frame" and "current frame" is provided. A "frame" is a set of signals from the plurality of pixels that are read in sequence. In the preferred embodiment of FIG. 2, signals corresponding to one row of pixels 100 are simultaneously transferred to vertical read lines 102 and transferred to difference detection circuits 104. Then the next row of pixels in the scanning sequence is read by transferring that row of pixel signals to the vertical read lines 102. After all the rows in the sequence have been read, a frame is complete. A subsequent frame is then read by repeating the sequence of reading the pixels row-by-row.

After an initial frame is read (e.g., the first signal after starting the system), a legacy signal, or charge, from a previous frame remains on a gate region of the transistor QA until a current frame is to be read. Accordingly, the terms "previous frame" and "current frame" refer to frames of pixels read in sequence.

Thus, in the following description a signal charge for the previous frame is already stored in transistor QA's gate region and a signal charge for a current frame is newly generated by photodiode PD and is transferred to QA after the previous frame's signal is transferred to capacitor CR, as described below.

In this state, transistor QX in pixel 100 and transistor QR in difference detection circuit 104 are made conductive and a source follower effect operates on transistor QA, and the charge corresponding to the signal charge for the immediately previous frame stored in transistor QA's gate region charges capacitor CR in difference detection circuit 104 via vertical read line 102. Transistor QP in pixel 100 is made conductive and the signal charge stored in transistor QA's gate region is discharged and initialized.

Then, transistor QT in pixel 100 is made conductive and the signal charge for the current frame newly generated by photodiode PD is transferred to transistor QA. Transistor QX in pixel 100 and transistor QS in difference detection circuit 104 are made conductive and a source follower effect operates on transistor QA, and the signal charge for the current frame transferred to transistor QA's gate charges capacitor CS in difference detection circuit 104 via vertical read line 102.

That is, the charge corresponding to the signal charge for the immediately previous frame is stored in capacitor CR in difference detection circuit 104, and the charge corresponding to the signal charge for the current frame is stored in capacitor CS.

Also, the signal charge for the current frame transferred to pixel 100's transistor QA gate is held in transistor QA's gate region, and in the next frame is used as the signal charge for the previous frame.

Comparison circuit XA obtains an absolute value for the difference between the signal voltages corresponding to the charges on capacitors CR and CS, which represent the incident light on photodiode PD in previous and current frames, respectively. Thus, if CR and CS are different, a change in luminescence has occurred in the surveillance area. Comparison circuit XA compares the voltages on capacitors CR and CS and outputs a binary signal indicating "1" (a signal level indicating that change occurred) if the absolute value reaches or exceeds a predetermined value. Conversely, comparison circuit XA outputs a signal indicating "0" (a signal level indicating that change has not occurred) if the absolute value is less than the predetermined value. The signal output from comparison circuit XA in this manner (equivalent to a difference signal) is sequentially output from the image sensor 12 via a horizontal scanning circuit 108.

In this manner the difference signal output from visible light image sensor 12 is supplied to image sensor read circuit 4 via cable 22.

Based on the difference signal supplied from visible light image sensor 12, image sensor read circuit 4 calculates the number of pixels in a region that includes the portion where change occurred (hereinafter "number of moving body pixels"), and calculates a size of the moving body according to the number of moving body pixels and an optical magnification and a distance from the detection head 2 to the subject 30. And, based on the moving body size thus calculated, the image sensor read circuit 4 decides whether or not the moving body is approximately the size of a human body and generates a binary signal that indicates the decision result (hereinafter "moving body signal") and supplies the moving body signal to the decision circuit 5.

For example, in a situation in which a 400,000 pixel image sensor is used as the visible light image sensor 12 and the optical magnification and distance from detection head 2 to the subject are set so that the detection area is three square meters, the area equivalent to one pixel is 0.225 $cm^2$. If one assumes that the approximate size of a human body is 150×40 cm and that the size of a small animal is approximately 10×5 cm, then the size of a human body is equivalent to about 27,000 pixels and the size of a small animal is equivalent to about 200 pixels. Therefore, the image sensor read circuit 4 should decide that a moving body within the detection area is about the size of a human body if the number of moving body pixels exceeds 2,000, or so, pixels.

Incidentally, in FIG. 3, at timing trace (c), the periods during which the moving body signal is at a high level (i.e., t4–t5 and t9–t10) indicate that a moving body about the same size as a human body is present in the detection area.

Based on the infrared signal supplied from the infrared sensor read circuit 3 and the moving body signal supplied from the image sensor read circuit 4, detection circuit 5 decides whether or not an intruder (equivalent to a moving human body) is present, and generates a signal indicating that decision result (hereinafter "decision signal").

The process of generating a decision signal by decision circuit 5 is described. First, when the infrared signal supplied from infrared sensor read circuit 3 is at a high level, thus indicating that a subject having a greater infrared radiation as compared to the surroundings has entered the detection area, decision circuit 5 holds the infrared signal in a high level state for a predetermined period of time (the periods equivalent to t1–t3 and t7–t11 in FIG. 3).

Also, when the moving body signal supplied from the image sensor read circuit 4 is at a high level, thus indicating that a moving body about the same size as a human body is present in the detection area, the decision circuit 5 holds the moving body signal in a high level state for a predetermined period of time (the periods t4–t6 and t9–t12 in FIG. 3).

When the infrared signal after holding (shown as trace (b) in FIG. 3) and the moving body signal after holding (trace (d) in FIG. 3) are both at a high level (time interval t9–t11 in FIG. 3), the decision circuit 5 generates a high level signal (indicating that an intruder is present) as the decision signal.

That is, the interval during which the infrared signal and the moving body signal both go high, as in time intervals t9–t11 in FIG. 3, the decision signal is made high to indicate that a human being has intruded into the detection area.

At the moment that the decision signal generated by decision circuit goes high, alarm generation circuit 6 may be arranged to generate an alarm indicating that an intruder has been detected. Furthermore, the interval during which an alarm is generated is not limited to the interval during which the decision signal is at a high level. For example, this period may be from the moment the decision signal temporarily goes high until an alarm stop switch (not shown in drawings) is operated. Alternatively, the decision signal may also be used to operated other systems such as video recording devices or video monitors.

As stated, in preferred embodiments, the infrared signal and moving body signal are held for a predetermined time interval. In a preferred embodiment, the visible light image sensor 12 generates a difference signal every 1/30th of a second (approximately once every 33ms), whereas the hold period for the infrared sensor 10 is about 100 ms. Therefore, there is little possibility of the infrared signal (FIG. 3, trace (a)) and the moving body signal (FIG. 3, trace (c)) both going high simultaneously unless the signals are held high for a predetermined time interval after they are triggered high by detection of infrared rays or image size, respectively.

Also, there can be instances in which the amount of change in infrared rays exceeds the predetermined value because some portion of a human being such as a face or hands, which are typically exposed and thus have higher infrared radiation as compared to clothed body portions, enters the field of view of the infrared sensor 10, but the size of the detected moving body (face or hands) does not yet exceed the predetermined size. When more of the subject body enters the field of view, the change in infrared radiation may be below the predetermined value, but the subject image size is now greater than its respective predetermined value. However, because both signals are not exceeding their respective predetermined values, the decision signal remains low indicating no intruder. This situation could lead to a failure to detect an intruder.

Thus, occurrences of the aforesaid detection failures can be reduced by holding the infrared signal and the moving body signal high for a predetermined time interval after they are triggered high by detection of infrared rays (amount or change in amount) and image size, respectively.

However, erroneous detection may also occur if the hold period is too long. A preferred hold period is approximately a few seconds.

The decision signal is at a low level, indicating no intruder, in the period during which only the infrared signal is high (FIG. 3, time intervals t1–t3) and in the period during which only the moving body signal is high (FIG. 3, time intervals t4–t6). Thus, an intruder indication does not occur, or is unlikely, when the subject detected is a small animal or a moving body whose temperature is about the same as its surroundings (for example, a swaying curtain).

The intruder detector of the present invention permits the respective fields of view of the infrared sensor 10 and the visible light image sensor 12 to be arranged so as to include all of the detection/surveillance area, so that intruders can be detected with good accuracy.

The intruder detector of the present invention includes the visible light image sensor 12 for generating the difference signal. Thus, the detector of the present invention does not need peripheral circuits such as an A/D conversion circuit, image memory, and image processing circuit that are mandatory in the case of many prior art detection apparatuses that are equipped with a visible light image sensor for generating simple image data.

The embodiments describe above include a pyroelectric infrared point sensor for detecting infrared radiation amounts or changes. However, an inexpensive infrared image sensor having few pixels, (for example, four pixels in a 2×2 matrix) is also suitable for detecting subjects that have a temperature that is higher than its surroundings.

Also, this embodiment decides the size of a moving body using the number of moving body pixels, but other methods may be suitable to decide the size of the moving body. For example, a method that uses the number of pixels that change or a method that extracts the edge portion of the moving body by analyzing difference signals. Other methods are also suitable.

In addition, in this embodiment infrared sensor 10 and visible light image sensor 12 have a common field of view and their position is adjusted in advance to include all of the detection area. But, for example, when the infrared sensor field of view and the visible light image sensor field of view are narrower than the detection area, it is possible to detect an object having a higher temperature than its surroundings within the detection area using a plurality of infrared sensors with different fields of view, and combine the field of view of a visible light image sensor with the field of view of an infrared sensor which detected an object having a higher temperature than the surroundings.

In other alternative embodiments, a difference signal may be generated by comparison of images. For example, the output of a visible light image sensor that generates simple image data may be converted by an A/D converter, and the image data for two consecutive frames may be stored in an image memory. Then the difference between two consecutive frames at the pixel unit may be detected using the digital image data held in the image memory, thereby generating a difference signal.

In alternative embodiments, the fields of view of the infrared sensor 10 and the visible light image sensor 12 are not identical or overlapping. For example, if the field of view of the infrared sensor 10 and the field of view of the visible light image sensor 12 are adjacent and the separation between each sensor's field of view is small, the system may decide whether or not the conditions of a high infrared radiation subject and a humanoid sized subject are the same subject by adjusting the time period during which the infrared signal is held at a high level or the time period during which the moving body signal is held at a high level, or both.

In another alternative embodiment, the detection of an object of higher temperature than its surroundings may be detected by using a thermal-type infrared sensor such as a pyrometer.

In addition, the intruder detector of the present invention generates a difference signal based on a visible light optical image. Thus, preferred embodiments are suitable for detecting an intruder during the day. However, alternative embodiments of the invention can detect an intruder at night by illuminating the detection area with near-infrared light (for example, near 800 nm), to which visible light image sensor 12 is sensitive.

In the above-described embodiments, the image sensor read circuit 4, decision circuit 5, and alarm generation circuit 6 are portrayed as discrete circuits. Alternatively, the image sensor drive circuit 4, decision circuit 5, and alarm generation circuit 6 may be fabricated as integrated circuits. Furthermore, because of miniaturization in semiconductor chip technology, preferably these circuits are fabricated on a single integrated circuit.

The present invention encourages miniaturization and cost reduction by making it possible to detect a moving body using a simple circuit structure without providing peripheral circuits such as an A/D conversion circuit, image memory, and image processing circuits.

Thus, this invention makes it possible to reduce erroneous detection as compared to an intruder detection apparatus equipped with a visible light image sensor or pyroelectric-type infrared point sensor alone. Further, this invention can maintain a low cost as compared to an intruder detection apparatus equipped with an infrared image sensor.

Furthermore, the present invention eliminates the time lag between the first moment of confirmation that the size of a moving body has reached or exceeded the specified size and the first moment of confirmation that the amount of infrared rays or the amount of change in infrared rays within the detection area due to the moving body has reached or exceeded the specified value. This method thus reduces detection failures.

In the image sensor of the present invention, the difference detection circuit 104 compares pixel signals of current and previous frames. As described, the pixel signals are successive signals, that are time sequenced pixel signals that are provided to the difference detection circuit one after another. However, other sequences are also suitable and may be employed to reduce the size of the image signal (not the size of the detected image) or increase the system speed. Thus, a current frame pixel signal may be compared to a pixel signal from several frames earlier. This may be less accurate, but may nonetheless be suitable in some applications.

This specification sets forth the best mode for carrying out the invention as known at the time of filing the patent application and provides sufficient information to enable a person skilled in the art to make and use the invention. The specification further describes preferred materials, shapes, configurations and arrangements of parts for making a using the invention. However, other such materials, shapes, configurations, and arrangements may by used and it is intended that the scope of the invention shall only be limited by the language of the claims and the law of the land as pertains to valid U.S. patents.

What is claimed is:

1. A humanoid detector, comprising:

(a) a moving body detection sensor that detects a moving body in a first surveillance area and provides a moving body signal when a detected moving body exceeds a predetermined size;

(b) an infrared sensor that detects infrared radiation within a second surveillance area and provides an infrared detection signal when detected infrared radiation levels exceed a predetermined value; and (c) a human body detection circuit that receives the moving body signal and the infrared detection signal, and provides a decision signal indicating that a humanoid body is in the first or second surveillance areas when the moving body detection sensor provides the moving body signal and the infrared sensor provides the infrared detection signal simultaneously.

2. The humanoid detector of claim 1, wherein the detected infrared radiation is an absolute level of infrared radiation that is radiating from the second surveillance area.

3. The humanoid detector of claim 1, wherein the detected infrared radiation is a change in the level of infrared radiation that is radiating from the second surveillance area.

4. The humanoid detector of claim 1, wherein the moving body detection sensor is a visible light image sensor that detects a moving body by detecting changes in luminescence level of pixel elements of the visible light image sensor.

5. The humanoid detector of claim 1 wherein the first and second surveillance areas are substantially coincident.

6. The humanoid detector of claim 1, wherein the human body detection circuit receives the infrared detection signal and holds the infrared detection signal for a predetermined time interval and the human body detection circuit provides the decision signal indicative of a humanoid in the first or second surveillance areas when the human body detection circuit receives the moving body signal while the human body detection circuit is holding the infrared detection signal.

7. The humanoid detector of claim 1 wherein the human body detection circuit receives the moving body signal and holds the moving body signal for a predetermined time interval and the human body detection circuit provides the decision signal indicative of a humanoid in the first or second surveillance areas when the human body detection circuit receives the infrared detection signal while the human body detection circuit is holding the moving body signal.

8. The humanoid detector of claim 1, wherein the infrared sensor is a pyroelectric infrared sensor.

9. The humanoid detector of claim 1, further comprising an intruder indicator that receives the decision signal and generates an intruder indication when the decision signal is indicative of a humanoid in the first or second surveillance areas.

10. A human body detection method, comprising the steps:

(a) detecting a moving subject using a visible light image of a surveillance area;

(b) detecting infrared radiation in the surveillance area; and (c) determining a size of the mov ing subject; and (d) providing a decision signal that is indicative of a human body in the surveillance area when the size of the moving subject exceeds a predetermined size and the detected infrared radiation exceeds a predetermined value simultaneously.

11. The human body detection method of claim 10, wherein the step of providing a decision signal indicative of a human body in the surveillance area occurs when the detected infrared radiation exceeds the predetermined value within a predetermined time interval after the size of the moving body exceeds the predetermined size.

12. The human body detection method of claim 10, wherein the step of providing a decision signal indicative of a human body in the surveillance area occurs when size of the moving body exceeds the predetermined size within a predetermined time interval after the detected infrared radiation exceeds the predetermined value.

13. The human body detection method of claim 10, further comprising the step of providing an alarm noise when the decision signal indicates a human body in the surveillance area.

14. The human body detection method of claim 10 wherein the step of detecting a moving subject using a visible light image comprises converting incident light on a photodiode into an electrical signal that is amplified and provided to a difference detection circuit that determines whether a level of luminescence has changed in the surveillance area by detecting a difference in successive electrical signals.

15. The human body detection method of claim 10 wherein the step of detecting a moving subject using a visible light image comprises focusing incident light onto an array of pixels that convert the incident light into electrical signals and detecting differences in time sequenced electrical signals in a difference detection circuit and providing a first binary signal that is indicative that a luminescence level has changed more than a threshold value and a second binary signal that is indicative that the luminescence level has not change more than the threshold value.

16. The human body detection method of claim 10 wherein the step of providing a decision signal that is indicative of a human body in the surveillance area when the size of the moving subject exceeds a predetermined size and the detected infrared radiation exceeds a predetermined value simultaneously comprises holding an infrared signal high for a first predetermined time interval after the onset of detecting infrared radiation greater than the predetermined value and holding a moving body signal high for a second predetermined time interval after the onset when the size of the moving body exceeds the predetermined size and providing the decision signal indicative of a human body in the surveillance area when the infrared signal and the moving body signal are high simultaneously.

17. The human body detection method of claim 16 wherein the first predetermined time interval is substantially equal to the second predetermined time interval.

18. A humanoid detector, comprising:

(a) a first sensor that receives incident light from a surveillance area and provides a first signal indicative of motion of a subject body in the surveillance area;

(b) a second sensor that receives infrared radiation from the surveillance area and provides a second signal indicative of the infrared radiation from the surveillance area; and (c) decision circuits that receive the first and second signals, determine whether the first and second signals exceed respective first and second threshold values and provide a decision signal that indicates that a humanoid is present in the surveillance area when the first and second signals exceed their respective first and second threshold values simultaneously.

19. The humanoid detector of claim 18, wherein the first sensor comprises a plurality of solid-state pixel elements that convert incident light into electrical signals.

20. The humanoid detector of claim 19, wherein the first sensor further comprises the plurality of pixel elements arranged in a matrix of rows and columns and further including a plurality of difference detection circuits wherein each difference detection circuits receives time sequenced pixel signals and compares pixel signals generated at a first time and a second time from a corresponding pixel element to provide a difference signal that indicates that a luminescence level has changed at the corresponding pixel.

21. The humanoid detector of claim 20, wherein the difference signal is a sequence of binary signals and a first binary signal indicates that the luminescence level of a particular pixel changed more than a predetermined threshold value and a second binary signal indicates that the luminescence level did not change more than a predetermined threshold value.

22. The humanoid detector of claim 21, wherein the decision circuits determine a size of the subject body that moved by determining a number of first binary signals in a frame of the difference signals.

23. The humanoid detector of claim 18, wherein the first threshold value is a value of a number of pixels upon which a humanoid body would be imaged by a lens that focuses incident light on an array of photodiodes in a solid-state camera element.

24. The humanoid detector of claim 18, wherein the first threshold value is a value greater than a number of pixels upon which a small animal would be imaged by a lens that focuses incident light on an array of photodiodes in a solid-state camera element.

25. The humanoid detector of claim 18, wherein the second sensor is a pyroelectric infrared sensor.

26. The humanoid detector of claim 18, wherein the second sensor is a pyroelectric infrared image sensor.

27. The humanoid detector of claim 26, wherein the pyroelectric infrared image sensor has less than 10 pixel elements therein.

28. The humanoid detector of claim 18, further comprising an alarm that receives the decision signal and provides an audible noise when the decision signal indicates a human body is located in the surveillance area.

29. A humanoid detector, comprising:

(a) a first sensor having a plurality of solid-state pixel elements that convert incident light from a surveillance area into electrical signals and including a difference detection circuit that compares time sequenced electrical signals from the pixel elements to determine if a change in luminescence level occurs at each pixel element and wherein the first sensor provides a first signal indicative of the change in luminescence level;

(b) a second sensor comprising an infrared sensor that detects infrared radiation within the surveillance area and provides a second signal that is indicative of the detected infrared radiation; and (c) a human body detection circuit that receives the first and second signals and that uses the first signal to determine a size of a subject area within the surveillance area in which the luminescence level changed and that provides a decision signal that indicates a humanoid presence in the surveillance area when the size of the subject area exceeds a predetermined size and the second signal exceeds a predetermined value simultaneously.

* * * * *